US010384485B2

(12) United States Patent
Sportel et al.

(10) Patent No.: US 10,384,485 B2
(45) Date of Patent: Aug. 20, 2019

(54) TRANSFER PAPER FOR INKJET PRINTING

(71) Applicant: COLDENHOVE KNOW HOW B.V., Eerbeek (NL)

(72) Inventors: Koert Johannes Sportel, Eerbeek (NL); Cornelis Hendricus Cornelissen, Eerbeek (NL)

(73) Assignee: COLDENHOVE KNOW HOW B.V., Eerbeek (NL)

( * ) Notice: Subject to any disclaimer, the term of this patent is extended or adjusted under 35 U.S.C. 154(b) by 0 days.

(21) Appl. No.: 15/735,869

(22) PCT Filed: Jun. 13, 2016

(86) PCT No.: PCT/NL2016/050423
§ 371 (c)(1),
(2) Date: Dec. 12, 2017

(87) PCT Pub. No.: WO2016/200264
PCT Pub. Date: Dec. 15, 2016

(65) Prior Publication Data

US 2019/0001728 A1 Jan. 3, 2019

(30) Foreign Application Priority Data

Jun. 12, 2015 (NL) ..... 2014965

(51) Int. Cl.

| | |
|---|---|
| ***B41J 2/005*** | (2006.01) |
| ***B41M 5/025*** | (2006.01) |
| ***B41M 5/035*** | (2006.01) |
| ***B41M 5/50*** | (2006.01) |
| ***B41M 5/52*** | (2006.01) |

(52) U.S. Cl.
CPC ..... *B41M 5/508* (2013.01); *B41J 2/0057* (2013.01); *B41M 5/0256* (2013.01); *B41M 5/035* (2013.01); *B41M 5/0355* (2013.01); *B41M 5/52* (2013.01); *B41M 5/5218* (2013.01); *B41M 5/5236* (2013.01); *B41M 5/5254* (2013.01); *B41M 2205/02* (2013.01)

(58) Field of Classification Search
CPC .... B41J 2/0057; B41M 5/0256; B41M 5/035; B41M 5/0355; B41M 5/42; B41M 5/508; B41M 5/52; B41M 5/5218; B41M 5/5236; B41M 5/5254; B41M 2205/02; B32B 37/26; B32B 37/268
See application file for complete search history.

(56) References Cited

U.S. PATENT DOCUMENTS

| | | | | |
|---|---|---|---|---|
| 4,731,647 | A * | 3/1988 | Kohashi | H04N 1/508 346/140.1 |
| 5,095,317 | A * | 3/1992 | Takei | B41J 2/315 346/105 |
| 2005/0019583 | A1* | 1/2005 | Goto | B41M 5/52 428/421 |
| 2006/0135364 | A1* | 6/2006 | Massa | B41M 5/38207 503/227 |
| 2014/0109324 | A1 | 4/2014 | Rasmussen | |

FOREIGN PATENT DOCUMENTS

| | | | |
|---|---|---|---|
| CN | 1315906 | A | 10/2001 |
| DE | 2710230 | A1 | 9/1978 |
| EP | 1102682 | A1 | 5/2001 |
| EP | 1125015 | | 4/2003 |
| EP | 2418090 | A2 | 2/2012 |
| JP | 61049894 | A | 11/1986 |
| WO | WO-0006392 | A1 | 2/2000 |
| WO | WO-2014095762 | A1 | 6/2014 |

OTHER PUBLICATIONS

"Dutch Application Serial No. 2014965, Search Report dated Jan. 26, 2016", w/ English Translation, (Jan. 26, 2016), 11 pgs.
"International Application Serial No. PCT/NL216/050423 International Preliminary Report on Patentability dated Dec. 12, 2017", (Dec. 12, 2017), 5 pgs.
"International Application Serial No. PCT/NL216/050423 Search Report dated Oct. 24, 2016", (Oct. 24, 2016), 4 pgs.
"International Application Serial No. PCT/NL216/050423 Written Opinion dated Oct. 24, 2016", (Oct. 24, 2016), 4 pgs.
"Chinese Application Serial No. 201680039670.1, Office Action dated Jan. 30, 2019", (Jan. 30, 2019), 9 pgs.

* cited by examiner

*Primary Examiner* — Anh T Vo
(74) *Attorney, Agent, or Firm* — Schwegman Lundberg & Woessner, P.A.

(57) ABSTRACT

The invention is directed to a transfer paper suitable for high speed inkjet printing comprising a base layer and a film layer suitable for receiving viscous ink and releasing disperse dye from said viscous ink by having a porosity of 100 to 500 ml/min, wherein the film comprises film forming material.

13 Claims, No Drawings

TRANSFER PAPER FOR INKJET PRINTING

CROSS-REFERENCE TO RELATED APPLICATIONS

This application is a U.S. National Stage Filing under 35 U.S.C. 371 from International Application No. PCT/NL2016/050423, with an international filing date of Jun. 13, 2016, which claims the benefit of Netherlands Patent Application No. 2014965, with a filing date of Jun. 12, 2015, the entire disclosures of which are incorporated herein by reference.

The invention is in the field of transfer paper. In particular the present invention relates to transfer paper that can be used for inkjet printing in digital sublimation transfer printing.

Transfer paper is used in digital sublimation transfer printing to transfer an image from a printer to a substrate. This image is first printed on the transfer paper after which the image is transferred to the substrate by applying heat and pressure. The image may be printed on the transfer paper by contact printing, e.g. by rotary screen printing, or by contactless printing such as inkjet printing. Over the last decades, inkjet printing has gained in popularity for its versatility and low cost in printing small batches or samples. Due to the development of specialized transfer paper for inkjet printing, as described for instance in EP1102682, which is incorporated herein in its entirety, excellent printing quality in terms of transfer efficiency, brilliance of colors, print sharpness (no bleeding), print evenness and/or image density can be obtained.

A drawback of inkjet printing is however that to achieve the same printing quality the printing should typically be slower than contact printing. This problem is inherent to inkjet printing in general. For regular inkjet printing, i.e. inkjet printing where paper itself is the substrate (viz. not transfer printing), considerable improvements have been made by the introduction of new types of ink that allow faster printing, for instance up to 100 m/min. This is achieved by a higher droplet dosing frequency (e.g. 40 kHz). These inks, as commercialized for print heads produced by e.g. Xaar, Kyocera and Ricoh, have compositions which prevent clogging of the nozzles of the inkjet print head during fast (or high speed) printing and allow the ink to penetrate faster into the paper substrate, such that offset or ghosting by ink adhesion to the discharge lead rollers is prevented.

U.S. Pat. No. 8,795,424 and EP2551305, which are incorporated herein in their entirety, describe examples of the above-mentioned inks for high speed inkjet printing. These inks are typically characterized by the high content of glycerol or diols or derivatives thereof, such as glycol or derivatives thereof and 1,3-propanediol or derivatives thereof of up to about 50 wt. %, which compounds are used as humectants (also referred to as moisturizing agents), or as penetrating agents. The presence of these humectants or penetrating agents results in a higher viscosity and concomitant longer drying times of the ink after printing. Traditional inks for the slower traditional inkjet printing have for instance typical viscosities of around 3 to 5 mPa·s at 25° C. while the new inks for high speed inkjet printing typically have viscosities of 7 to 15 mPa·s or even up to 100 mPa·s at 25° C. (see e.g. WO2011079402 in this respect).

The present inventors found that when viscous inks for high speed printing in sublimation transfer printing are used, the longer drying period of the ink is problematic since the quality of the printing is reduced. This problem is encountered in particular with the above-mentioned current transfer paper for inkjet printing as e.g. described in EP1102682. A disadvantage of slower drying is e.g. offsetting from the print image on the backside of the paper at roll take up. This can lead to ghosting images at transfer and will damage the printed image on the printing side of the paper. It can also lead to contamination of lead rollers in the printer.

WO2014095762 describes a transfer paper composed of a substrate having a porosity of 0-1000 ml/min that is coated with an aqueous liquid, which after drying results in a coating layer that has a porosity that is larger than 100 ml/min. The low porosity of the base paper is required to reduce the effective amount of aqueous liquid that is applied.

The present invention is directed to an improved transfer paper for high speed inkjet printing, preferably with the above-mentioned viscous inks. This objective has been met by providing a transfer paper comprising a base layer and a film layer suitable for receiving and releasing viscous ink by having a porosity of 100 to 500 ml/min, wherein the film comprises film forming material, wherein the base layer comprises a base paper having a porosity of more than 1000 ml/min. Surprisingly, the transfer paper in accordance with the present invention allows the ink to penetrate the paper quickly, thereby shortening the drying time, without any deterioration of the printing quality due to for instance bleeding or ghosting. This is surprising because most viscous inks comprise penetration enhancers (see for instance EP2551305) and it is to be expected that this would lead to loss of printing quality when applied to a porous layer than is typically used in transfer printing.

Without wishing to be bound by theory, it is believed that the high porosity of the base paper of more than 1000 ml/min contributes to the fast drying of the paper of the present invention, as this high porosity is believed to enable the absorption of any humectants or penetrating agents that are present in the ink. The base layer of the present invention is typically formed by a base paper. The base paper preferably has a porosity of more than 2000 ml/min, more preferably 2500-3000 ml/min. The base paper can be made of traditional pulp, i.e. lignocellulose fibrous material originating from wood. This layer provides a support for the film layer and the structure of the transfer paper for its handling during the printing process.

The film layer is suitable or adapted for receiving the ink during the printing process. This means that the film layer is on the side of the paper that is meant to be printed on. The porosity of the film layer is 100 to 500 ml/min, preferably 150 to 300 ml/min as determined via ISO 5636-3 on e.g. a L&W Bendtsen Tester of AB Lorentzen & Wettre, Kista, Sweden.

The inventors found that the porosity of the film layer in accordance to the present invention is advantageous, since it results in a lower drying time while the transfer efficiency remains high. It is believed that since the film layer is not entirely sealing (i.e. the porosity is not below 100 ml/min), absorbance of in particular the viscous components such as glycol is facilitated. However, the film layer is sufficiently sealing (i.e. the porosity is high enough in accordance with the present invention) to retain the disperse dye in the top of the film layer which results in a high transfer efficiency. Since the porosity of the base layer is generally many times greater (viz. more than 1000 ml/min, preferably about 2000 to 3000 ml/min), the porosity of the film layer may be determined while the film layer is on the base layer.

The porosity of the film layer in accordance with the present invention is optimal for the viscous ink in terms of image quality and drying times. Thus, notably, the film layer enables short drying periods while preventing bleeding of the ink such that different colors of ink run into each other areas causing loss of color contrast and uniformity. Faster drying of the inks thus results in sharper images and no offset of ink on the back side of the paper when the paper is rolled up after inkjet printing.

Typically, drying times of less than 2 min are preferred for prints of a loading degree of 100%. More preferably the drying time is less than 1 min, most preferably less than 30 seconds, for prints of a loading degree of 100%, for instance from 1 to 25 seconds. The loading degree is the amount of ink that is printed on the paper. For instance, a loading degree of 300% means that three colors are printed one over the other with a maximum color density/intensity. A loading degree of 100% means that one color with a maximum color density/intensity is applied.

Besides the receiving functionality of the film layer, this layer is also suitable or adapted for releasing the disperse dye of the ink during the transfer onto the substrate. It may be appreciated that after the printing of the image onto the transfer paper, the ink will dry and the disperse dye of the ink can be transferred to the substrate upon heat and/or pressure. The porosity of the film layer in accordance with the present inventions, prevents the dyes of the ink from penetrating too deep into the paper. This results typically in high transfer efficiencies of up to 80% or more of the transfer paper. Transfer efficiency is the relative amount of disperse dye that is transferred to the substrate during the transfer process.

In the context of the present invention, with viscous ink is typically meant any ink that has a viscosity of more than about 5 mPa·s at 25° C. as determined by ASTM D445 or an equivalent technique.

The film forming layer comprises film forming material which typically comprises hydrophilic polymeric material such as carboxymethyl cellulose (CMC), polyvinyl alcohol (PVA), alginate, gelatin, starch or mixtures thereof. Typically, CMC is preferred. In a preferred embodiment of the present invention, CMC with a substitution degree of 0.2 to 0.3 is used.

However, for the types of viscous ink that comprise a particular high amount of glycol (derivatives) (e.g. 30 to 50 wt. %) and therefore are slightly more hydrophobic compared to traditional inks which contain more water, it may be preferred that the degree of substitution is lower, for instance 0.05 to 0.15. Alternatively or additionally, a more hydrophobic polymeric material such as ethyl cellulose, (methyl) hydroxylpropyl cellulose or cellulose acetate may be present in the film forming material to obtain the desired hydrophilic properties of the film layer. Careful selection of the hydrophilic character of the film layer will accelerate the penetration and thus shorten the drying time of the ink.

Without wishing to be bound by theory, the inventors believe that the typical long drying time of the viscous ink when using transfer paper that has a low porosity of the film layer (e.g. lower than 100 ml/min) may be the result of a mismatch in hydrophilicity of the film forming material and the viscous ink. Hence, the term viscous ink may cover any ink that contains more than 25 wt. %, preferably more than 40 wt. %, glycol (derivatives), such as glycol ethers. However, inks with the same drying properties (slow drying) but having a lower glycol (derivatives) content may also be covered by the term viscous ink.

The film forming material may further comprise filler, such as minerals. Particularly suitable are phyllosilicate minerals such as mica; clay minerals, such as kaolin, talcum, or smectite; or combinations thereof. Preferably kaolin and/or talcum are used as filler. The amount of the filler may be up to 20%, based on the total dry weight of the film layer, for instance 0-15 wt. %, preferably 1-10 wt. %. The filler is believed to further enhance the absorption of the humectants or penetrating agents present in the ink.

The film forming material may further comprise additives such as salts that influence the hydrophilicity of the film layer.

The thickness of the film layer as expressed by the dry weight per area is typically about 1 to 10 g/m$^2$. In a preferred embodiment of the present invention, the film layer has a thickness or dry weight of between 2 to 4 g/m$^2$.

Preferably, the film layer homogeneously covers the base layer. With the film homogeneously covering the base layer is meant that the film layer covers the base layers such that—upon inspection with an scanning electron microscope—the number of voids that are visible in the base layer covered by the film layer is uniformly reduced compared to uncovered base layer (over an area of 1 cm$^2$) such that the print quality over this area is practically uniform. The related variation in thickness of the film layer is typically ±100%, preferably ±50% of the dry weight per area of the film.

It may be appreciated that since the film layer is suitable for receiving the ink, this layer is located on the side of the transfer paper that is meant to be printed on. Hence, use of the transfer paper for inkjet printing on the film layer is a particular aspect of the present invention.

Preferably, the film layer is located on the wire side of the base layer. Since the wire side is smoother that the felt side, applying the film layer on the wire side facilitates homogeneous covering of the base layer. However, by applying more film forming material on the felt side of the base layer, homogeneous covering of the base layer on this side may also be achieved.

The base layer preferably has a dry weight of between 20 to 150 g/m$^2$, more preferably of between 40 to 70 g/m$^2$.

In a preferred embodiment, the dry weight of the transfer paper is between 30 to 150 g/m$^2$, more preferably between 50 to 70 g/m$^2$, most preferably about 66 g/m$^2$. However due to the ongoing development of base paper with increased strengths, the dry weight of the transfer paper may even be lower as long as the properties are not adversely affected thereby. The transfer paper in accordance with the present invention may be produced by forming a film layer on the base layer by applying film forming material on the base layer and subsequently spreading the film forming material over at least part of the base layer such that the film layer homogeneously covers at least part of the base layer. The film forming material is typically applied as a 10-25 wt. % aqueous solution. This film forming material is preferable applied as a viscous gel such that spreading of the material over the base layer is facilitated. A homogenous cover is typically achieved by a roll coater, a Meyer bar coater or a blade coater and subsequent drying of the film layer.

The porosity of the film layer may be influenced by the type, amount and/or concentration of the film forming material that is applied on the base layer, the porosity of the base layer and the presence of fillers.

In another particular embodiment, the film forming material is sprayed onto the base layer such that small droplets of the film forming material are formed on the base layer. The droplet then fuse together to form the homogeneous cover.

The desired porosity of the film layer can be obtained by selecting the appropriate amount of film forming material that is applied on the base layer.

It may be appreciated that the transfer paper may comprise additional layers besides the base layer and the film layer.

Alternatively, the barrier layer may be positioned in between the base and the film layer.

Furthermore, the film layer may for instance be two layers, present on either side of the base layer. These film layers may be identical or may be different in composition and/or porosity.

The transfer paper in accordance with the present invention is very suitable for use in high speed inkjet printing with viscous ink. The invention can be illustrated with the following examples.

EXAMPLE 1

A mixture of bleached long and short fibers and 4% filling material was used to form paper pulp. From this paper pulp a base layer having a porosity of 2500 ml/min was formed.

Next, an excess of a solution of 15 wt. % carboxymethyl cellulose (CMC, i.e. the film forming material) in water was applied on the base layer. A Meyer bar was used to remove part of the excess of the applied CMC solution such that a wet CMC layer of a wet weight of 16.6 g/m$^2$ remained on the base layer. After drying, a film layer formed having a dry weight of 2.5 g/m$^2$ and a porosity of 170 ml/min as determined by ISO 5636-3. The obtained transfer paper had a dry weight of 64 g/m$^2$.

EXAMPLE 2

A number of additional transfer papers were produced by a comparable method as illustrated in Example 1.

All transfer papers were used in a test to determine the drying time. To this end, commercially available Sensient, Elvajet SY 370 ink was used to print a test pattern with a printer suitable for printing Kyocera inks and the drying time of the pattern was determined (see Table 1).

TABLE 1

Drying Times of Transfer Papers

| Paper # | Basis weight (g/m$^2$) | Porosity (ml/min) | Drying Time (min) at relative ink amounts 100% | 200% | 300% |
|---|---|---|---|---|---|
| 1 | 120 | 220 | <0.3 | 1 | 3 |
| 2 | 64 | 170 | 1 | 5 | 9 |
| 3 | 64 | 66 | 2 | 7.5 | 12 |
| 4 | 45 | 10 | 2.5 | 9 | 12 |
| 5 | 70 | 0.5 | 4 | 11 | 15 |

The invention claimed is:

1. Transfer paper suitable for high speed inkjet printing comprising a base layer and a film layer suitable for receiving viscous ink and releasing disperse dye from said viscous ink by having a porosity of 100 to 500 ml/min, wherein the film comprises film forming material, wherein the base layer comprises a base paper having a porosity of more than 1000 ml/min.

2. Transfer paper according to claim 1, wherein the film forming material comprises carboxymethyl cellulose, polyvinyl alcohol, alginate, gelatin and/or starch.

3. Transfer paper according to claim 1, wherein the film layer has a porosity of 150 to 300 ml/min.

4. Transfer paper according to claim 1, wherein the film forming material comprises 0-15 wt % of one or more fillers.

5. Transfer paper according to claim 1, wherein said one or more fillers are selected from phyllosilicate minerals, preferably mica; clay minerals, preferably kaolin, talcum, or smectite; or combinations thereof.

6. Transfer paper according to claim 1, wherein said base paper has a porosity of more than 2000 ml/min, preferably 2500-3000 ml/min.

7. Transfer paper according to claim 1, wherein the film layer has a dry weight of between 1 to 10 g/m$^2$, preferably of between 2 to 4 g/m$^2$.

8. Transfer paper according to claim 1, wherein the base layer has a dry weight of between 20 to 150 g/m$^2$, preferably of between 40 to 70 g/m$^2$.

9. Method for the production of transfer paper according to claim 1 comprising forming a film layer on the base layer by applying film forming material on at least part of the base layer and subsequently spreading the film forming material over the base layer such that the film layer homogeneously covers the base layer.

10. Method for sublimation transfer printing, wherein an image is printed by an inkjet printer on the film layer of the transfer paper according to claim 1.

11. Method according to claim 10, wherein the image is printed with viscous ink.

12. Method for sublimation transfer printing, wherein an image that has been printed on the film layer of the transfer paper according to claim 8, is transferred to a substrate by applying pressure and/or heat.

13. Use of a transfer paper accordance with claim 1 for high speed inkjet printing with viscous ink.

* * * * *